US007427069B2

(12) United States Patent
Bateman et al.

(10) Patent No.: US 7,427,069 B2
(45) Date of Patent: Sep. 23, 2008

(54) FOLDING TARGET STAND

(75) Inventors: Kyle Bateman, Provo, UT (US); Nicholas Stincelli, Springville, UT (US); Nathan Raisor, Provo, UT (US); Gene Pearcey, Durango, CO (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 11/514,370

(22) Filed: Aug. 30, 2006

(65) Prior Publication Data

US 2007/0045965 A1 Mar. 1, 2007

Related U.S. Application Data

(60) Provisional application No. 60/713,175, filed on Aug. 31, 2005.

(51) Int. Cl.
*F41J 1/10* (2006.01)

(52) U.S. Cl. ..... 273/407; 273/406

(58) Field of Classification Search ..... 273/403–410; 248/168, 170, 173

See application file for complete search history.

(56) References Cited

U.S. PATENT DOCUMENTS

| | | | | | |
|---|---|---|---|---|---|
| 429,942 | A | * | 6/1890 | McBride | 273/407 |
| 631,175 | A | | 8/1899 | Parnall | |
| 1,738,874 | A | | 12/1929 | Domingo | |
| 2,284,510 | A | | 5/1942 | Cates | |
| 2,372,111 | A | | 3/1945 | Norberg | |
| 2,905,469 | A | | 9/1959 | Taylor | |
| 3,087,701 | A | * | 4/1963 | Wallace | 248/166 |
| 3,392,980 | A | | 7/1968 | Ortega | |
| 3,515,388 | A | | 6/1970 | Zachmeier | |
| 4,232,867 | A | | 11/1980 | Tate, Sr. | |
| 4,288,080 | A | | 9/1981 | Laporte et al. | |
| 4,340,370 | A | | 7/1982 | Marshall et al. | |
| 4,540,182 | A | | 9/1985 | Clement | |
| 4,546,984 | A | * | 10/1985 | Towle et al. | 273/404 |
| 4,691,925 | A | | 9/1987 | Scholem | |
| 4,911,453 | A | | 3/1990 | Essex et al. | |
| 5,145,133 | A | * | 9/1992 | France | 248/168 |
| 5,240,258 | A | | 8/1993 | Bateman | |
| 5,324,043 | A | | 6/1994 | Estrella | |
| 5,350,180 | A | | 9/1994 | Acock | |
| 5,352,170 | A | | 10/1994 | Condo et al. | |
| 5,361,455 | A | | 11/1994 | Kiefer | |
| 5,598,996 | A | | 2/1997 | Rath | |
| 5,676,378 | A | | 10/1997 | West | |
| 5,829,753 | A | * | 11/1998 | Wiser | 273/407 |
| 5,906,552 | A | * | 5/1999 | Padilla | 473/421 |
| 5,947,477 | A | | 9/1999 | Turnipseed | |
| 5,967,523 | A | * | 10/1999 | Brownlee | 273/407 |
| 6,018,847 | A | | 2/2000 | Lu | |

(Continued)

OTHER PUBLICATIONS

Caswell International Corp., Product Literature, Copyright 2002.

(Continued)

*Primary Examiner*—Mark S Graham
(74) *Attorney, Agent, or Firm*—Bateman IP Law Group

(57) ABSTRACT

A folding target stand allows a shooter to easily mount a target at a number of different heights without requiring the use of tools and without requiring disassembly of the target stand. The target stand provides increased stability when struck by bullets and may be easily transported and stored without disassembly.

21 Claims, 11 Drawing Sheets

U.S. PATENT DOCUMENTS

| | | | | |
|---|---|---|---|---|
| 6,325,376 | B1 | 12/2001 | Elliott et al. | |
| 6,543,778 | B2 * | 4/2003 | Baker | 273/407 |
| 6,808,177 | B2 | 10/2004 | Dehart | |
| 7,219,897 | B2 | 5/2007 | Sovine et al. | |
| 2002/0183141 | A1 * | 12/2002 | Ouimette et al. | 473/454 |

OTHER PUBLICATIONS

Duelatron, Product Literature 1995.
Porta Target, Product Literature, Circa 2000.
Shootrite, Tactical Training Target, published prior to Apr. 4, 2005.

* cited by examiner

FOLDING TARGET STAND

RELATED APPLICATIONS

The present application claims the benefit of U.S. Provisional Application Ser. No. 60/713,175, filed Aug. 31, 2005, which is incorporated herein in its entirety.

BACKGROUND OF THE INVENTION

1. The Field of the Invention

The present invention relates to an improved bullet target stand. More specifically, the present invention relates to a folding target stand which is capable of presenting a bullet target to a shooter at varying heights, and which may be operated without the use of tools.

2. State of the Art

Bullet shooting and shooting competitions are quite common, both among hunters, sportsmen, outdoor or gun enthusiasts, and police, military personnel, etc. Shooting is undertaken as a recreational activity and as training. Frequently, shooting competitions are undertaken which involve a single shooter or multiple shooters. The shooters are required to accomplish a certain objective within a certain time period or with a particular accuracy. One such a shooting competition involves a wild west type shootout.

In such a shooting competition, multiple targets are placed at varying heights, distances, and locations within a shooting range or at some desired location. A shooter is required to hit the various targets in a particular order, or to hit the all of the targets as fast as possible, etc. It will be appreciated that much of the difficulty in having such a shooting competition is transporting the targets to the desired location and positioning the targets. Significant time is typically required to set up a number of targets. Additionally, many shooting ranges will not have a sufficient number of mounting brackets for mounting the desired targets, or the available mounting brackets will not be in the desired locations. Individuals or groups of shooters who desire to have such a competition may not have sufficient target mounts.

Additionally, many shooters simply desire a target stand which is easy to transport and operate. It is desirable to have a stand which may be operated without requiring the use of tools, and which allows a shooter to adjust the height of the target so as to accommodate various different shooting ranges or desired target positions.

There is thus a need for a target stand which is suitable for various target shooting situations including various shooting competitions. Such a target stand should allow the user to easily set up the target stand. Such a target stand should preferably allow a user to position the target at two or more heights. It is also preferable that a target stand allow a user to set up and operate the target stand without the use of tools. Preferably, the target stand is easily portable and configured so as to permit use in a variety of environments and a variety of different shooting scenarios.

SUMMARY OF THE INVENTION

It is an object of the present invention to provide an improved target stand. It is a further object of the present invention to provide an improved folding target stand which is relatively inexpensive and easy to use.

According to one aspect of the present invention, a target stand is provided which is portable, and which may be moved without disassembly. A target stand may be provided with legs which fold together and with a target mount which folds against the legs so as to present a compact assembly which is easy to transport.

According to another aspect of the present invention, a target stand is provided which may be operated without requiring the use of tools and without requiring disassembly of the target stand. A target stand may be formed which has slots formed therein which allow the target mount to be moved into the desired position and to be locked into the desired position. The target stand may be formed with legs which are pivotably attached so as to allow the legs to extend into an operating position. The legs and target mount may be attached to the target stand in a manner which does not require the loosening and tightening of bolts during use or which does not require the use of tools to operate the stand.

According to another aspect of the invention, a target stand is provided which allows a user to mount the bullet target in different positions so as to vary the height of the target. A target mount is provided which may be rotated and locked into different positions so as to position a bullet target at different heights. A target stand is also provided which utilizes multiple mounting locations for such a bullet target to thereby facilitate mounting of the target at different heights while maintaining proper orientation of the target.

According to another aspect of the invention, a target stand is provided which better withstands the impacts from bullets striking the bullet target or target stand. A target stand is provided which has three legs and in which two of the legs face rearwardly from the target stand so as to better stabilize the target stand when struck by bullets.

These and other aspects of the present invention are realized in an improved target stand as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The various embodiments shown accomplish various aspects and objects of the invention.

DETAILED DESCRIPTION

The drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
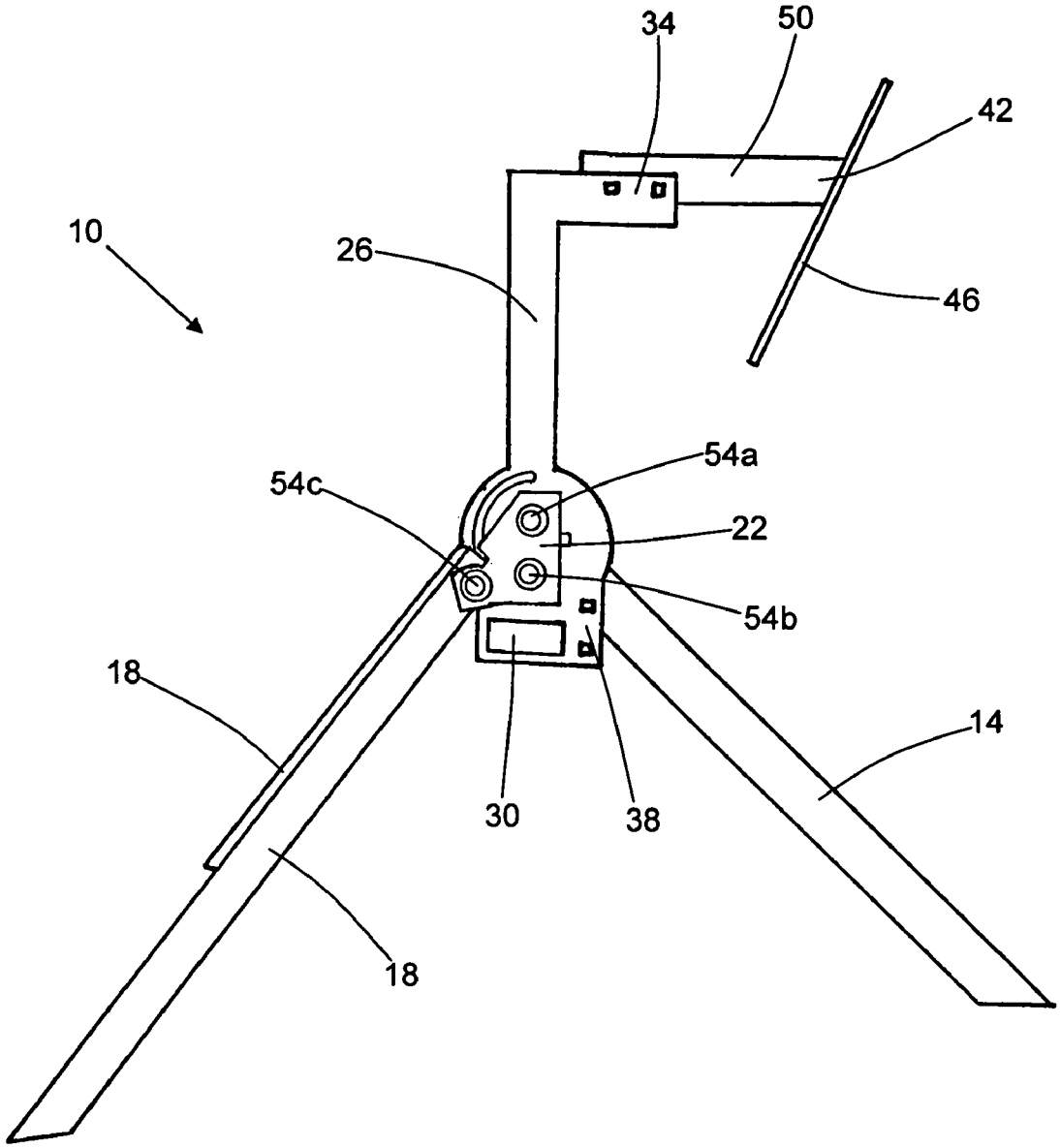
FIG. 1 shows a side view of a target stand according to the present invention.

Turning to FIG. 1, a side view of a target stand according to the present invention is shown. The target stand, indicated generally at 10, includes a front leg 14, two rear legs 18, a pair of side brackets 22, and a target mounting arm 26. The target mounting arm 26 preferably includes an integral handle 30, an upper target mount 34, and a lower target mount 38, as well as additional features which will be discussed later in greater detail. A bullet target 42 including a target plate 46 and a mounting arm 50 is attached to one of the target mounts 34, 38. The mounting arm 50 is designed to hold the target plate 46 at a predetermined angle relative to the ground (typically between 10 and 20 degrees, and preferably 15 degrees) so as to ensure safe operation of the target stand 10.

In use, the target mounting arm 26 may be rotated in a counterclockwise between the position shown and a second position. In the position shown, the upper target mount 34 is in a proper position for mounting a bullet target 42, i.e. the bullet target is mounted in the desired angle relative to the ground. In the embodiment shown, the target mounting arm 26 may be rotated by 90 degrees counterclockwise so as to allow mounting of the bullet target 42 to the lower target mount 38.

The front leg 14 is oriented so as to extend forwards towards a shooter. The rear legs 18 are oriented so as to extend rearwardly such that, if viewed from the top, the rear legs would form about an 80 to 90 degree angle between each other, forming about an 130 to 140 degree angle between the front leg 14 and each rear leg 18. Each of the front leg 14 and rear legs 18 form about a 45 degree angle to the ground. If desired, the legs may be bent or otherwise provided with feet.

The arrangement of the legs 14, 18 provides greater stability to the target stand 10. Tripods, easels, stands, etc. (including target stands) typically include three legs which extend symmetrically from a central point (as viewed from above, a 120 degree angle is formed between each of the legs). Additionally, existing stands utilize two legs which extend forwards and one leg which extends backwards so as to place the weight over two of the legs (such as an easel, which places an object between and above the two front legs). The prior art configuration (placing the weight of the object being supported between two front legs) provides greater stability in a static position, and has thus been used in prior art target stands.

The arrangement of the legs according to the present invention provides lessened static stability as the weight of the target is above a single front leg, but provides greater stability and resistance to movement when struck by a bullet by providing two rearwardly facing legs 18. It is well known in the prior art designs to have the rear leg driven into the ground by the force of bullets hitting the targets. This changes the angle of the target relative to the ground and can create unsafe ricochet situations.

Arranging the rearwardly facing legs 18 so as to form an angle of about 80 to 90 degrees as viewed from above provides additional resistance to movement when struck by a bullet and provides greater protection against ricochets or splatter from bullet hitting the legs 18 being directed towards a shooter. Thus, the leg arrangement of the present target stand provides both greater resistance to movement of the target stand when hit by bullets and reduced risk of ricochet to the shooter. Bolts 54 or other suitable fasteners are used to hold the various pieces of the target stand together, and include a center bolt 54*a*, a lower bolt 54*b*, and rear leg bolts 54*c*.

Figure 2:
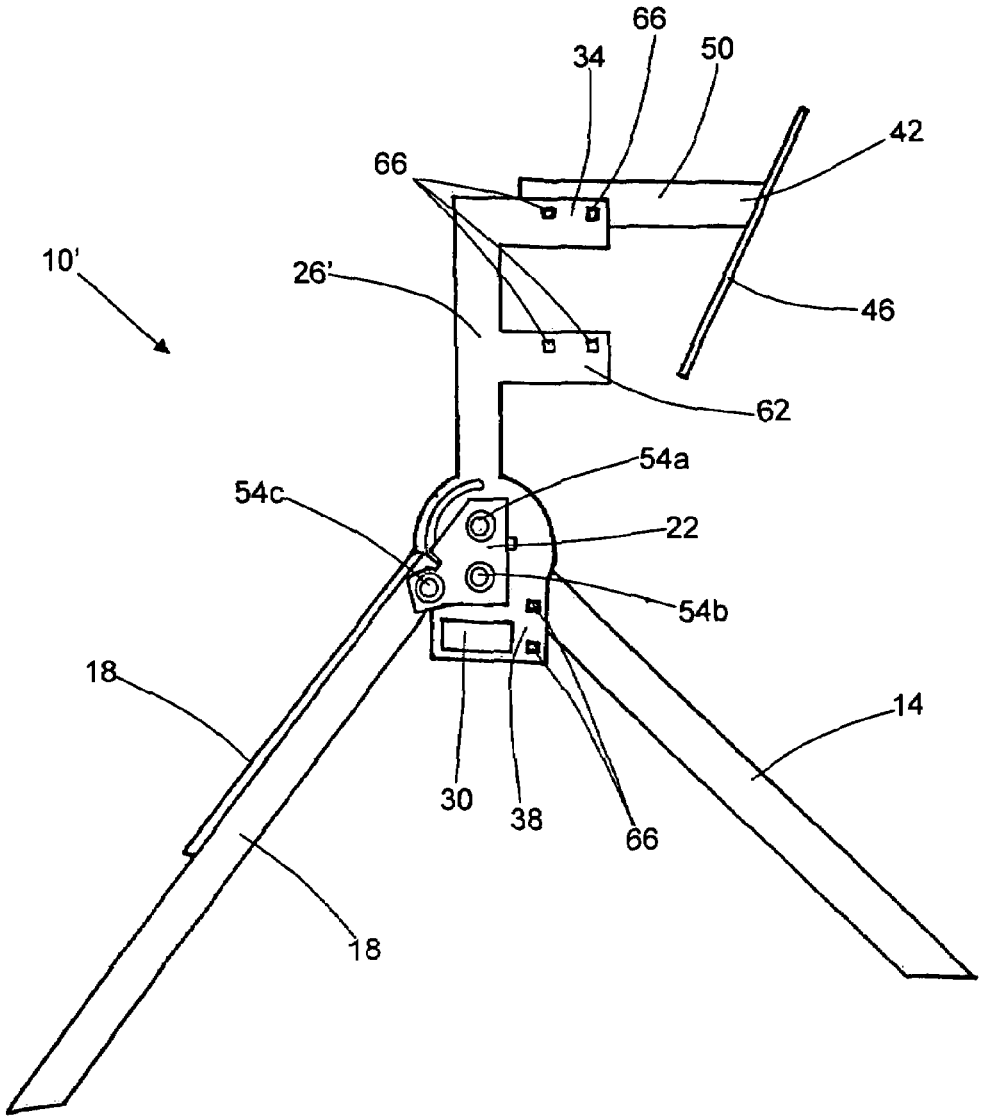
FIG. 2 shows a side view of an alternate embodiment of a target stand according to the present invention.

Turning now to FIG. 2, a side view of a target stand according to the present invention is shown. The target stand 10' is identical to that of FIG. 1 with the exception that a middle target mount 62 is formed on target mounting arm 26'. In operation, when the target mounting arm 26' is in the position shown, a bullet target 42 may be mounted either to the upper target mount 34 as shown or to the middle target mount 62. The bullet target 42 is typically attached to a target mount 34, 38, 62 via holes 66. Each target mount 34, 38, 62 is formed with at least two holes 66. The holes are formed such that when the target mounting arm 26' is in a position whereby a bullet target may be attached to a particular mount 34, 38, 62, the holes 66 are in a predetermined orientation, such as horizontal as is shown. This ensures that the bullet target 42 is mounted at the predetermined angle relative to the ground.

The target stand 10' provides a shooter with 3 different heights at which a bullet target may be mounted. With the target mounting arm 26' in the position shown, a bullet target 42 may be mounted to either the upper target mount 34 or the middle target mount 62. By rotating the target mounting arm 26 by 90 degrees counterclockwise a bullet target 42 may be mounted to the lower target mount 38. The holes 66 are shown as square holes, allowing a user to use carriage bolts, which have a square portion near the bolt head, and wing nuts to mount the bullet target 42, eliminating the use of tools to mount or re-mount the bullet target. Thus, in a shooting competition where many different target heights are desired, a user may easily adapt the present target stand 10' to one of three available target heights. Using multiple target stands 10 or 10' allows multiple targets to be mounted at varied heights and locations.

Figure 3:
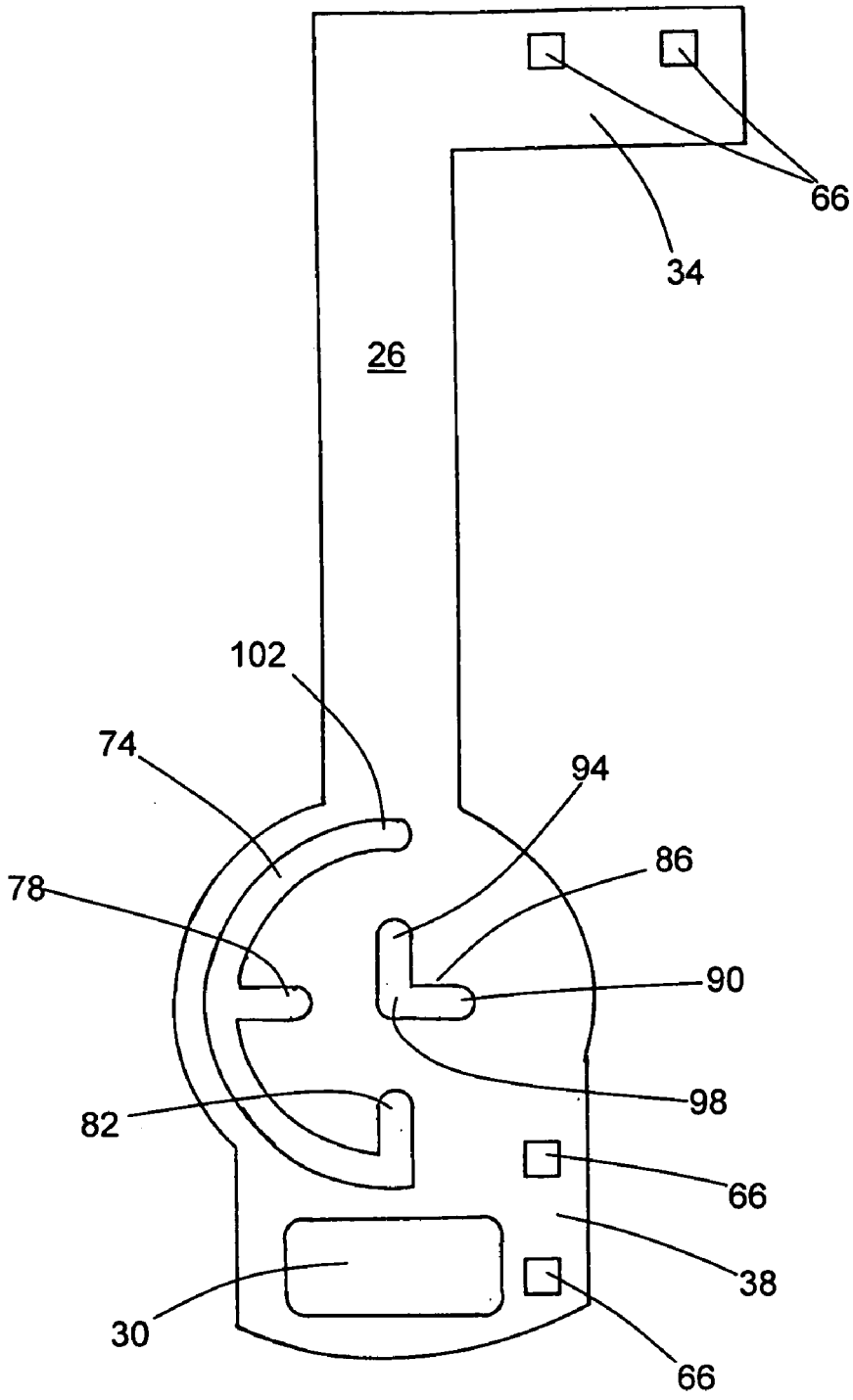
FIG. 3 shows a plan view of a target mounting arm according to the present invention.

Turning now to FIG. 3, a side view of the target mounting arm 26 is shown. The target mounting arm 26 is shown with an upper target mount 34 and a lower target mount 38 as previously shown. One novel aspect of the present invention is the slots formed in the target mounting arm 26. An arcuate slot 74 having inwardly extending sections 78, 82 is formed in the target mounting arm 26. An L shaped slot 86 is formed such that a first section 90 is in alignment with extending section 78 and a second section 94 is in alignment with extending section 82, and such that the corner 98 of the L shaped slot 86 is placed in the radial center of the arcuate slot 74.

In operation, the center bolt 54*a* (FIG. 1 or 2) passes through a side bracket 22 (FIG. 1 or 2), through the front leg 14 (FIG. 1 or 2), through the L shaped slot 86, and through another side bracket 22 and is fastened with a nut. The lower bolt 54*b* (FIG. 1 or 2) passes through the side bracket 22, the front leg 14, the arcuate slot 74, and the other side bracket 22. The center bolt 54*a* and the lower bolt 54*b* are spaced apart from each other at the same distance as the arcuate slot 74 is spaced apart from the corner 98 of the L shaped slot so as to allow the target mounting arm 26 to rotate by pivoting the center bolt 54*a* in the corner 98 of the L shaped slot while sliding lower bolt 54*b* around the outer arc of arcuate slot 74.

When the target mounting arm 26 is oriented vertically as shown, the lower bolt 54*b* is aligned with the section 82 of the arcuate slot 74 such that the target mounting arm may be moved downwardly relative to the side brackets 22, causing the upper bolt 54*a* to slide into section 94 of the L shaped slot and causing lower bolt 54*b* to slide into section 82 of arcuate slot 74, thereby locking the position of the target mounting arm and preventing rotation of the target mounting arm. The target mounting arm 26 is then in a position whereby a user may mount a target 42 (FIG. 1 or 2) to the upper target mount 34 or a lower target mount if used 62 (FIG. 1 or 2). The target mounting arm 26 may then be lifted up relative to the side brackets 22 to thereby unlock the target mounting arm and allow rotation of the target mounting arm.

The target mounting arm may be rotated by about 90 degrees counterclockwise so as to align the lower bolt 54*b* with section 78 of arcuate slot 74, allowing the target mounting arm 26 to be moved relative to the side brackets 22 to thereby move center bolt 54*a* into section 90 of L shaped slot 86 and to move lower bolt 54*b* into section 78 of arcuate slot 74, locking the target mounting arm 26 into a second position whereby a target 42 (FIG. 1 or 2) may be attached to the lower target mount 38. It will be appreciated that the angle of rotation required may be changed by varying the position of slot sections 78 and 90.

If the target mounting arm 26 is in an unlocked position, it may be rotated counterclockwise until lower bolt 54*b* is adjacent the clockwise end 102 of the arcuate slot 74, positioning the upper target mount 34 between the legs 14, 18 (FIG. 1 or 2) so as to present a more compact shape for carrying or storing (the legs fold inwardly as will be discussed) and positioning the handle 30 in an upward position, making the target easy to carry. The target mounting arm 26 and other pieces of the target stand 10 are typically formed from ¼ inch thick steel, although other materials or thicknesses of materials are suitable. It is desirable to use a material which resists deformation when struck by a bullet and which is sufficiently heavy to prevent the target stand 10 from tipping over when struck by a bullet.

Figure 4A:
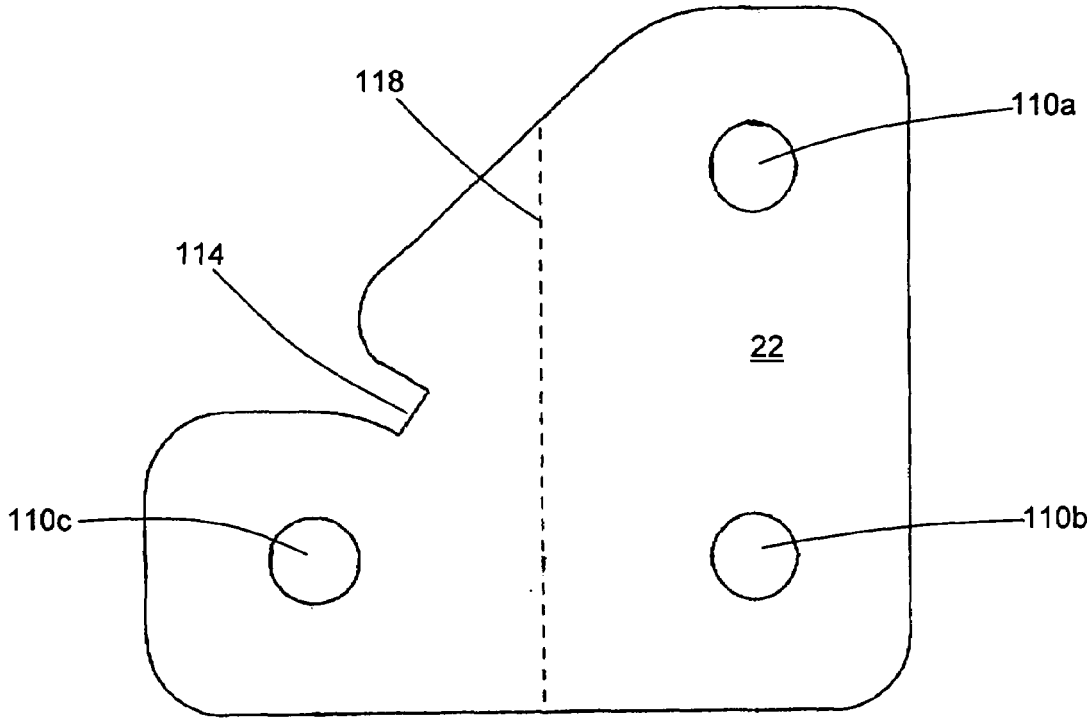
FIG. 4A shows a plan view of a side bracket according to the present invention.
Figure 4B:
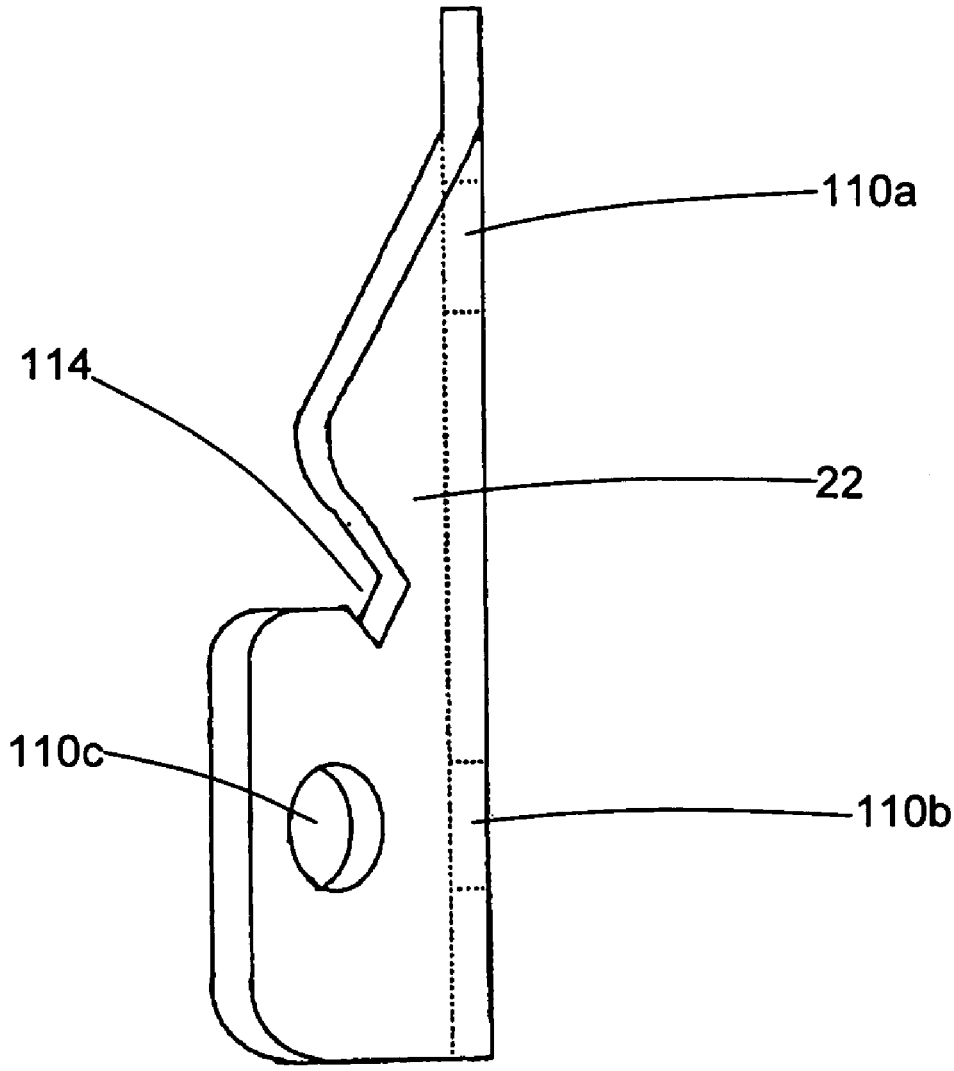
FIG. 4B shows a side view of a side bracket according to the present invention.

Turning now to FIG. 4A, a side view of a side bracket 22 is shown. The side bracket 22 includes a first hole 110*a* for receiving center bolt 54*a*, a second hole 110*b* for receiving lower bolt 54*b*, and a third hole 110*c* for receiving a rear leg bolt 54*c*. A rear leg 18 is pivotably attached to the side bracket 22 via rear leg bolt 54*c*. A notch 114 is formed to receive a tab formed on the rear leg 18 so as to limit the rotation of the rear leg 18 so the rear leg extends outwardly at about a 45 degree angle to the ground when opened. The side bracket 22 is bent along dashed line 118 at about a 40 to 50 degree angle, thereby determining the angle formed between the two rear legs 18 when viewed from above as has been previously discussed. FIG. 4B shows an end view of the side bracket 22, illustrating the bend formed at line 118. A left and a right handed side bracket 22 are used for each target stand 10.

Figure 5A:
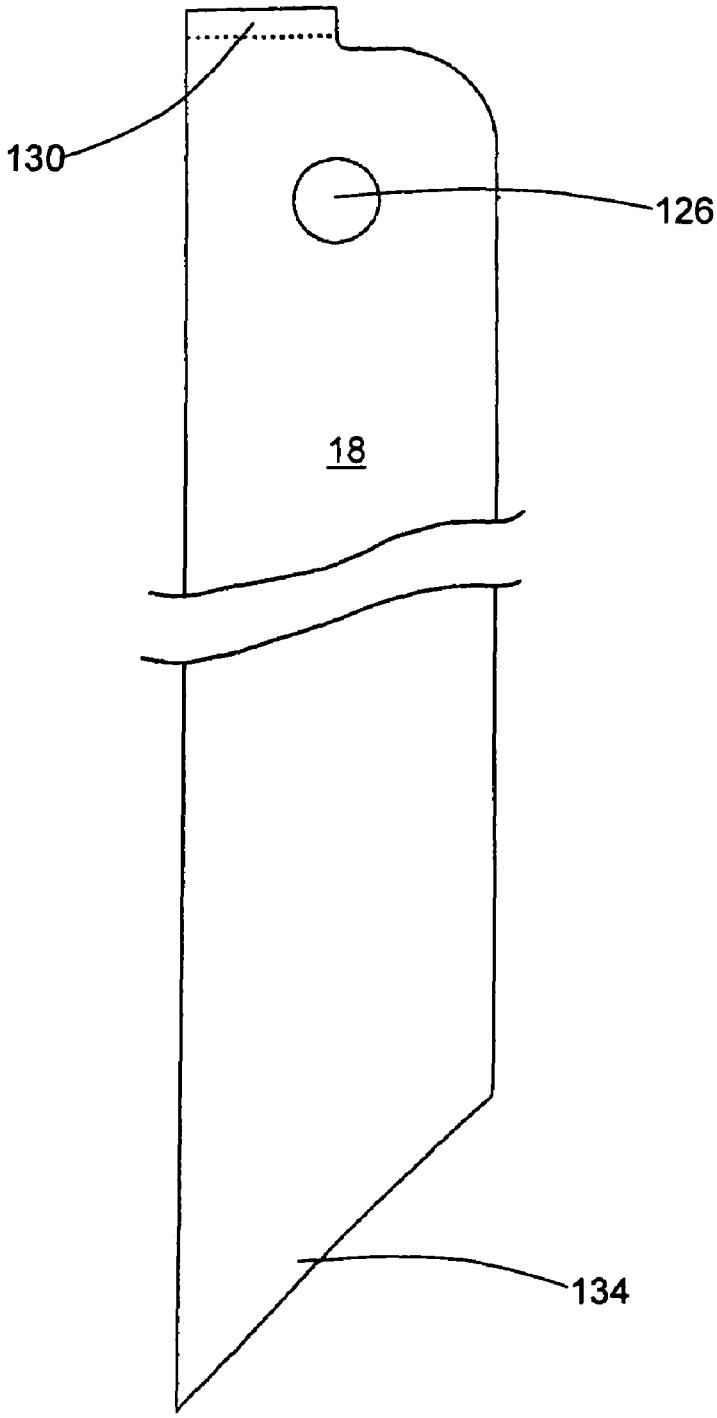
FIG. 5A shows a side view of a rear leg according to the present invention.
Figure 5B:
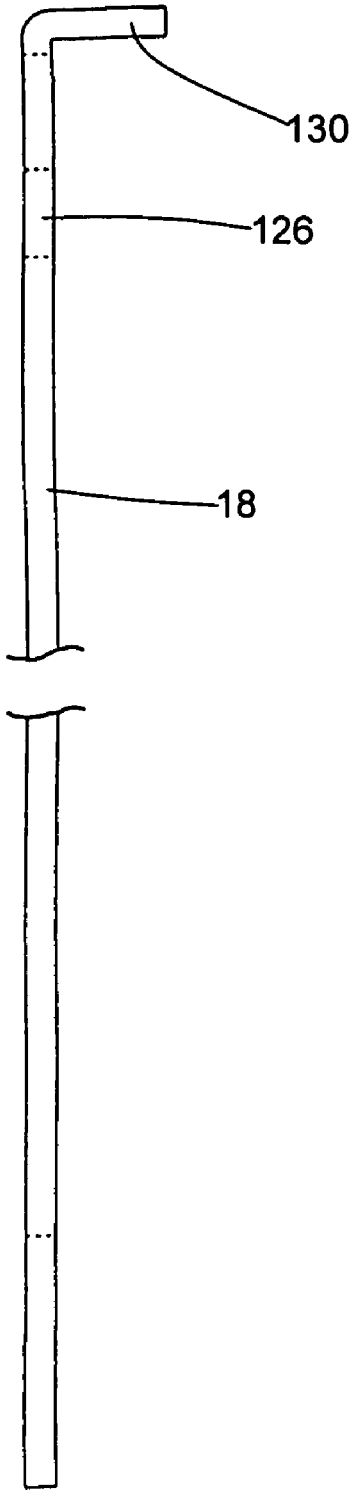
FIG. 5B shows a top view of a rear leg according to the present invention.

Turning now to FIG. 5A, a side view of a rear leg 18 of a target stand according to the present invention is shown. The rear leg is formed with a hole 126 which is used to attach the leg 18 to side bracket 22 via rear leg bolt 54*c* and hole 110*c*. A tab 130 is formed on the rear leg 18 so as to limit the rotation of the leg 18 by contacting side bracket 22 at slot 114. FIG. 5B shows a top view of rear leg 18 so as to more clearly show tab 130. The lower end 134 of leg 18 is formed at about a 45 degree angle so as provide a flat surface upon which the target stand rests. It may also be bent or have a foot attached thereto.

Figure 6:
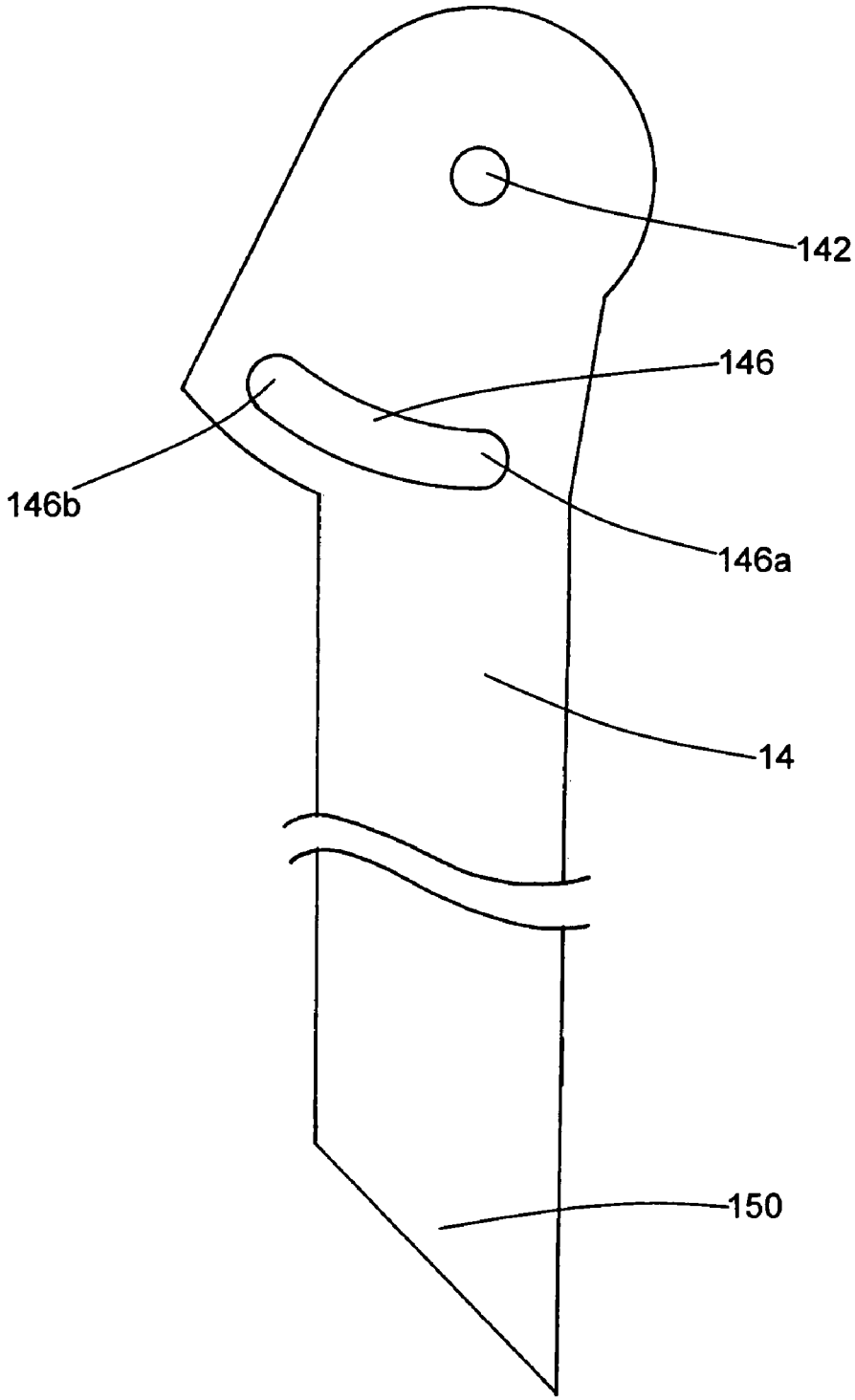
FIG. 6 shows a plan view of a front leg according to the present invention.

Turning now to FIG. 6, a side view of the front leg 14 of a target stand according to the present invention is shown. The front leg 14 preferably is formed with a center hole 142 which receives center bolt 54*a* and an arcuate slot 146 which receives lower bolt 54*b* to thereby pivotably attach the front leg 14 to the target stand 10. The front leg 14 may be pivoted from a first storage position whereby the lower bolt 54*b* is located at a first end 146*a* of the arcuate slot 146 to a second operating position whereby the lower bolt 54*b* is located at a second end 146*b* of the arcuate slot. The lower end 150 of leg 14 is formed at about a 45 degree angle so as to provide a flat surface upon which the target stand 10 rests. The lower end 150 could be bent so as to provide a foot (not shown).

Figure 7:
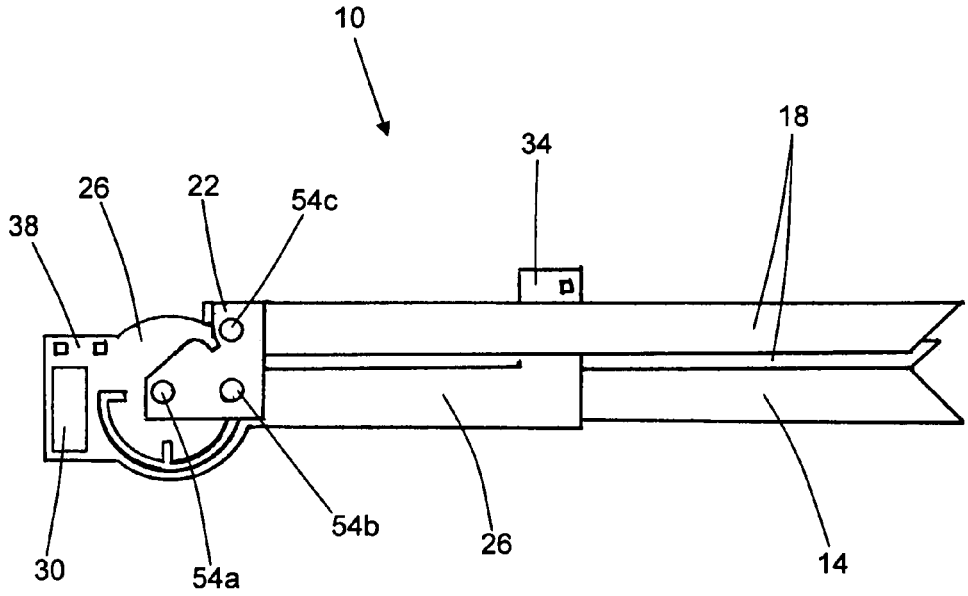
FIG. 7 shows a side view of a target stand according to the present invention.

Turning now to FIG. 7, a side view of a target stand 10 according to the present invention is shown. The target stand 10 has been folded into a compact shape for storage or transportation. The front leg 14 and rear legs 18 pivot inwardly as previously discussed and as presently shown. Target mounting arm 26 has been pivoted into a storage position as previously discussed so as to place the upper target mount 34 between the legs 14, 18, and so as to place the handle 30 at the end of the folded target stand 10. In such an orientation, the target stand 10 is compact for easy storage and transportation. Because of the design of the target stand, no tools or disassembly is required to place the target stand 10 in such an orientation. In such a configuration, a compact stand about 3 feet long and 6 inches wide is provided. When set up, the stand will hold a target up to 5 or more feet above the ground.

Figure 8:
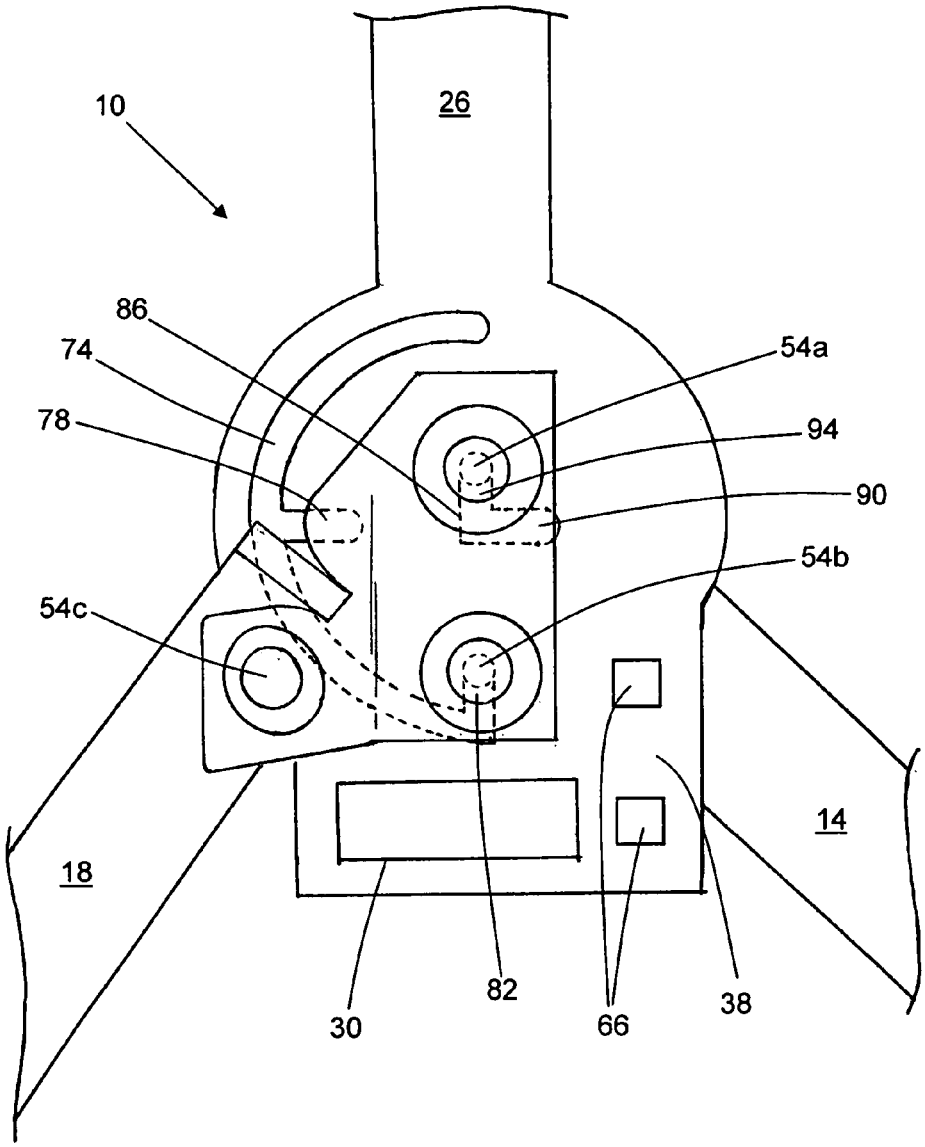
FIG. 8 shows a close up side view of a central portion of a target stand according to the present invention.

Turning now to FIG. 8, a close up side view of the central portion of the target stand 10 of the present invention is shown. It can be seen how, with the target mounting arm 26 in a vertical position, the center bolt 54*a* may be placed in section 94 of L shaped slot 86 and lower bolt 54*b* may be placed in section 82 of arcuate slot 74, locking the target mounting arm in the position shown. It will be appreciated that if the target mounting arm 26 is moved upwardly relative to the rest of the target stand 10, center bolt 54*a* will be moved downwardly in section 94 of L shaped slot 86 so as to be in alignment with section 90. Lower bolt 54*b* will similarly be moved downwardly in section 82 of arcuate slot 74. After moving the target mounting arm 26 upwardly, the target mounting arm is in a position where it may be rotated counterclockwise by pivoting about the center bolt 54*a* while lower bolt 54*b* is moved through the arcuate slot 74.

Once the target mounting arm 26 has been rotated by 90 degrees, the lower bolt will be adjacent section 78 of arcuate slot 74. The target mounting arm 26 may then be moved downwardly relative to the rest of the target stand 10, causing the upper bolt 54*a* to slide into section 90 of L shaped slot 86 and causing lower bolt 54*b* to slide into section 78 of arcuate slot 74, thereby locking the target mounting arm into the position shown in FIG. 9.

Figure 9:
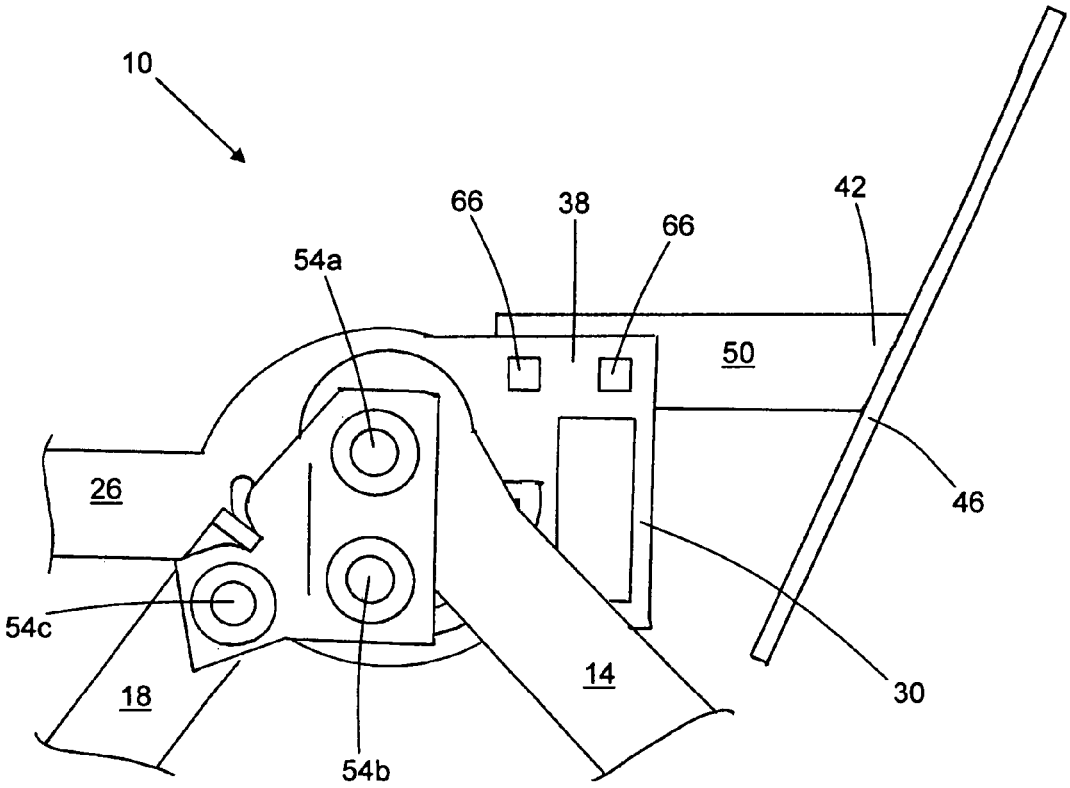
FIG. 9 shows a close up side view of a central portion of a target stand according to the present invention.

As will be appreciated from FIG. 9, the target mounting arm 26 is in a position wherein lower target mount 38 is in a proper orientation to allow a bullet target 42 to be mounted thereto. The bullet target 42 shown has a mounting arm 50 and target plate 46 as is shown in FIG. 1 and FIG. 2. The target stand 10 is thus designed so that, if desired, the same target may be attached to any of the available target mounts. Such a configuration provides a user with greater flexibility in using the target stand. The upper target mount 34 (FIG. 1) is placed behind lower target mount 38 so as to be protected by bullet target 42 from being struck by bullets, reducing the risk of damage or ricochets. If the target mounting arm 26 is moved upwardly relative to the rest of the target stand 10, the target mounting arm may then be rotated counterclockwise until it is between the legs 14, 18, allowing the target stand to be folded into the position shown in FIG. 7 by pivoting the legs inwardly.

It will be appreciated that the angle of rotation required to move the target mounting arm 26 from a first position such as that shown in FIG. 8 allowing a bullet target 42 (FIG. 1) to be mounted to an upper target mount 34 (FIG. 1) or middle target mount 62 (FIG. 2) to a second position such as that shown in FIG. 9 allowing a bullet target to be mounted to a lower target mount 38, or the position of the target mounting arm in the first or second positions, may be modified by changing the position of sections 78 and 82 of arcuate slot 74 and sections 90 and 94 of L shaped slot 86. It is not critical that the target mounting arm 26 extend vertically in the first operative position (as shown in FIG. 8) and horizontally in the second operative position (as shown in FIG. 9). Thus, the position of sections 78 and 82 of arcuate slot 74 and sections 90 and 94 of L shaped slot 86 may be moved so as to position the target mounting arm 26 at a different angle when in a first or second position. It is beneficial that the upper, middle, and lower target mounts all be positioned at the same angle relative to the ground and have the same configuration of mounting holes so as to allow the same type of bullet target to be mounted to each of the different target mounts. Additionally, a number of different shapes and sizes of bullet targets may be provided which are all configured to mount to the same size and shape of target mount, allowing a shooter to use the target stand with a number of different targets as is desired.

It will also be appreciated by those of skill in the art that the holes 66 are preferably provided to enable a user to attach any of a variety of presently available targets. Thus, the target stand 10, 10' can be sold separately and used with a number of targets already owned by the purchaser.

There is thus disclosed an improved folding target stand. The preceding figures each illustrate different aspects of then target stand, and for clarity, each figure does not show all aspects of the invention. It will be appreciated that numerous changes may be made to the present invention without departing from the scope of the claims. It will also be appreciated that a folding target stand according to the present invention need not include all features as shown in the preceding figures.

What is claimed is:

1. A bullet target stand comprising:

a plurality of legs, the legs being movable from a first position wherein the legs are disposed generally adjacent each other in a storage position and movable to a second position wherein the legs extend outwardly so as to support the bullet target stand; and a target mounting arm connected to the legs, the target mounting arm comprising at least one target mount and being rotatable between a storage position wherein the target mounting arm is disposed adjacent the plurality of legs and a first operative position and a second operative position wherein the target mounting arm extends above the legs, the target mounting arm having a first target mount and a second target mount, and wherein the target mounting arm is pivotable between the storage position, the first operative position wherein the first target mount is configured to receive a target at a first height so as to present the target to a shooter, and the second operative position wherein the second target mount is configured to receive a target at a second height different than the first height so as to present the target to a shooter; and wherein the target mounting arm is configured for receiving a target so as to mount the target at a first height when the target mounting arm is disposed in the first operative position;

wherein the target mounting arm is configured for receiving a target so as to mount the target at a second height different than the first height when the target mounting arm is disposed in the second operative position such that the target is in the same relative orientation with respect to the ground as when mounted at the first height; and wherein the target mounting arm is selectively locked in the first operative position or in the second operative position by moving the target mounting arm downwardly relative to the legs.

2. The bullet target stand of claim 1, further comprising a plurality of bolts for holding the target mounting arm to the legs, and wherein slots in at least one of the legs and target mounting arm engage at least one of the bolts to lock to target mounting arm in the first operative position or second operative position.

3. The bullet target stand of claim 1, wherein the target mounting arm may be locked in a first position wherein a target may be mounted at a first height and a second position wherein a target may be mounted at a second height different than the first height.

4. The bullet target stand of claim 1, wherein the target mounting arm further comprises an integral handle, and wherein the handle extends outwardly from the target stand when the target mounting arm is disposed in the storage position.

5. A bullet target stand comprising:

a plurality of legs, the legs being movable from a first position wherein the legs are disposed generally adjacent each other in a storage position and movable to a second position wherein the legs extend outwardly so as to support the bullet target stand; and a target mounting arm connected to the legs, the target mounting arm comprising at least one target mount and being rotatable between a storage position wherein the target mounting arm is disposed adjacent the plurality of legs and a first operative position and a second operative position wherein the target mounting arm extends above the legs;

wherein the target mounting arm is configured for receiving a target so as to mount the target at a first height when the target mounting arm is disposed in the first operative position; and wherein the target mounting arm is configured for receiving a target so as to mount the target at a second height different than the first height when the target mounting arm is disposed in the second operative position such that the target is in the same relative orientation with respect to the ground as when mounted at the first height; and wherein the target mounting arm may be selectively locked in the first operative position by moving the target mounting arm downwardly.

6. A bullet target stand comprising:

a plurality of legs; and a target mounting arm having a first target mount and a second target mount, the target mounting arm being pivotable between a storage position wherein all legs are adjacent to each other and the target mounting arm is disposed between the plurality of legs, a first mounting position wherein the first target mount is positioned for receiving a target for presentation to a shooter at a first height, and a second mounting position wherein the second target mount is positioned for receiving a target for presentation to a shooter at a second height different than the first height but in the same relative orientation with respect to the ground.

7. The bullet target stand of claim 6, wherein the target mounting arm is selectively lockable in the first and second mounting positions.

8. The bullet target stand of claim 6, wherein the stand comprises a first leg pivotably attached to the target mounting arm, a second leg attached to the stand via a bracket, and a third leg attached to the stand via a bracket.

9. A bullet target stand comprising:

a plurality of legs; and a target mounting arm having a first target mount and a second target mount, the target mounting arm being pivotable between a storage position wherein all legs are adjacent to each other and the target mounting arm is disposed between the plurality of legs, a first mounting position wherein the first target mount is positioned for receiving a target for presentation to a shooter at a first height, and a second mounting position wherein the second target mount is positioned for receiving a target for presentation to a shooter at a second height different than the first height but in the same relative orientation with respect to the ground; and wherein the target mounting arm further comprises an arcuate slot formed therein, and further comprising at least one bolt for mounting at least one leg, the at least one bolt passing through the arcuate slot so as to permit the pivoting of the target mounting arm.

10. The bullet target stand of claim 9, wherein the target mounting arm further comprises a first straight slot and a second straight slot connected to the arcuate slot and configured for locking the target mounting arm into the first position and second position by sliding the at least one bolt into one of the first straight slot and second straight slot.

11. The bullet target stand of claim 10, wherein the target mounting arm further comprises an angle shaped slot disposed at the radial center of the arcuate slot.

12. A bullet target stand comprising:

a front leg extending forwards from a center of the stand;

a pair of rear legs extending rearwardly from the center of the stand, the front leg and rear legs, when extended, support the bullet target stand; and the front legs and rear legs being collapsible into a position wherein the legs are all disposed adjacent one another; and a bullet target mounting arm configured for receiving a bullet target, the bullet target mounting arm extending upwardly from the legs for holding a target for presentation to a shooter, and being rotatable into a position adjacent at least one of the legs when not in use so as to reduce the overall height of the bullet target stand; and wherein the bullet target mounting arm is configured for receiving a target so as to mount the target at a first height when the target mounting arm is disposed in a first operative position; and wherein the bullet target mounting arm is configured for receiving a target so as to mount the target at a second height different than the first height but in the same relative orientation to a shooter as when mounted at the first height when the target mounting arm is pivoted to a second operative position.

13. The bullet target stand of claim 12, wherein the target mounting arm is rotatable about an axis which is parallel to the ground so as to selectively present either a first target mount disposed at a first height or a second target mount disposed at a second height.

14. The bullet target stand of claim 13, wherein the target mounting arm is selectively lockable in a first operative position wherein the first target mount is presented to a user and a second operative position wherein the second target mount is presented to a user.

15. A bullet target stand comprising:

a plurality of legs, the legs being pivotable from a first position wherein the legs are disposed adjacent each other to a second position wherein the legs extend outwardly so as to support the bullet target stand; and a target mounting arm, the target mounting arm comprising at least one target mount and being movable between a first operative position wherein the target mounting arm extends to hold a bullet target at a first height so as to present the target to a shooter, a second operative position wherein the target mounting arm extends to hold a bullet target at a second height different from the first height so as to present the target to a shooter such that the target is in the same relative orientation to the shooter when mounted in the first height and the second height, and wherein at least one leg of the plurality of legs and the target mounting arm are movable to a position adjacent one another for storage; and wherein the target mounting arm may be selectively locked in an operative position by rotating the mounting arm to the operative position and sliding the target mounting arm downwardly relative to the rest of the bullet target stand.

16. The bullet target stand of claim 15, wherein the target mounting arm comprises a first target mount and a second target mount, and wherein the target mounting arm is pivotable between the first operative position, and the second operative position such that the first target mount is disposed to receive a bullet target and present said target in a shooting position when the target mounting arm is in the first operative position, and such that the second target mount is disposed to receive a bullet target and present said target in a shooting position when the target mounting arm is in the second operative position.

17. The bullet target stand of claim 15, wherein the target mounting arm further comprises an integral handle, and wherein the handle extends outwardly from the target stand when the target mounting arm is disposed in the storage position.

18. The bullet target stand of claim 16, wherein the target mounting arm is rotated by an angle to move between the first operative position and the second operative position, and wherein the first target mount and second target mount are disposed at said angle relative to each other such that the first target mount and second target mount are placed in the same orientation relative to a shooter when the target mounting arm is placed in the first position and second position respectively.

19. The bullet target stand of claim 15, wherein the plurality of legs and the target mounting arm are movable adjacent each other for storage.

20. The bullet target stand of claim 19, wherein the target mounting arm is movable to a position between the plurality of legs.

21. A bullet target stand comprising:

a plurality of legs, the legs being movable from a first position wherein the legs are disposed generally adjacent each other in a storage position and movable to a second position wherein the legs extend outwardly so as to support the bullet target stand; and a target mounting arm connected to the legs, the target mounting arm comprising at least one target mount and being rotatable between a storage position wherein the target mounting arm is disposed adjacent the plurality of legs and a first operative position and a second operative position wherein the target mounting arm extends above the legs;

wherein the target mounting arm is configured for receiving a target so as to mount the target at a first height when the target mounting arm is disposed in the first operative position;

wherein the target mounting arm is configured for receiving a target so as to mount the target at a second height different than the first height when the target mounting arm is disposed in the second operative position such that the target is in the same relative orientation with respect to the ground as when mounted at the first height, and wherein the target mounting arm is rotated by a first angle to move the target mounting arm between the first operative position and the second operative position, and wherein the target mounting arm comprises a first target mount extending therefrom and a second target mount extending therefrom, and wherein the first target mount is disposed at said first angle relative to the second target mount such that the first target mount is positioned to receive a target and present the target to a shooter when the target mounting arm is disposed in the first operative position and such that the second target mount is positioned to receive a target and present the target to a shooter when the target mounting arm is disposed in the second operative position.

* * * * *